US006612508B2

(12) United States Patent
Lambert

(10) Patent No.: US 6,612,508 B2
(45) Date of Patent: Sep. 2, 2003

(54) FUEL INJECTOR

(75) Inventor: Malcolm David Dick Lambert, Bromley (GB)

(73) Assignee: Delphi Technologies, Inc., Troy, MI (US)

( * ) Notice: Subject to any disclaimer, the term of this patent is extended or adjusted under 35 U.S.C. 154(b) by 10 days.

(21) Appl. No.: 09/760,012

(22) Filed: Jan. 12, 2001

(65) Prior Publication Data

US 2001/0032893 A1 Oct. 25, 2001

(30) Foreign Application Priority Data

Jan. 15, 2000 (GB) ..... 0000863

(51) Int. Cl.[7] ..... F02M 61/00

(52) U.S. Cl. ..... 239/533.12; 239/453; 239/533.7; 239/533.9; 239/556; 239/584

(58) Field of Search ..... 239/132, 132.1, 239/132.3, 132.5, 533.3, 533.7, 533.9, 533.12, 556, 128, 584, 452, 453

(56) References Cited

U.S. PATENT DOCUMENTS 3,460,760 A * 8/1969 Bluhm ..... 239/132.3
4,394,972 A * 7/1983 Potter ..... 239/453
4,817,873 A * 4/1989 McKay ..... 239/132.1
5,823,161 A 10/1998 Potz et al.
5,826,801 A * 10/1998 Kobayashi et al. .... 239/533.12
5,899,385 A 5/1999 Hofmann et al.
6,024,297 A * 2/2000 Greeves ..... 239/533.9
6,224,001 B1 * 5/2001 Cooke et al. ..... 239/533.12

FOREIGN PATENT DOCUMENTS

| | | |
|---|---|---|
| DE | 3928912 | 4/1990 |
| DE | 19847388 | 4/2000 |
| DE | 19919431 | 11/2000 |
| DE | 10002718 | 12/2000 |
| FR | 1005904 | 4/1952 |

OTHER PUBLICATIONS

Search Report for British Application GB0000863.1.

* cited by examiner

*Primary Examiner*—Steven J. Ganey
(74) *Attorney, Agent, or Firm*—Thomas N. Twomey

(57) ABSTRACT

A fuel injector for delivering fuel to a combustion space comprises a valve needle which is movable within a bore provided in a nozzle body and which is engageable with a seating to control the supply of fuel from the bore. The injector further comprises a return flow passage for permitting fuel to escape from the bore to a low pressure drain upon initial movement of the valve needle away from its seating. The injector may include a cover member which defines, together with the nozzle body, a part of the return passage for fuel through which fuel flows, in use, to reduce the temperature of the nozzle body.

8 Claims, 5 Drawing Sheets

FUEL INJECTOR

The invention relates to a fuel injector for use in supplying fuel to a combustion space of a compression ignition internal combustion engine. Such an injector is suitable for use in, for example, a common rail type fuel system.

Conventional fuel injectors of the outwardly opening type include a valve needle which is slidable within a bore provided in a nozzle body and is engageable with a seating, defined by the nozzle body, to control fuel delivery to the cylinder of the associated engine. The valve needle may be arranged within a sleeve member which defines, together with the valve needle, a delivery chamber for fuel, the sleeve member being provided with two axially spaced sets of outlet openings. The sleeve member is biased by means of a compression spring against an enlarged end region of the valve needle, the spring being arranged within a spring chamber.

In use, fuel is delivered to the spring chamber through a supply passage in communication with a source of fuel at high pressure, fuel within the spring chamber flowing into the delivery chamber by means of flats, slots or grooves provided on the valve needle. When the valve needle is moved outwardly from the bore by a first amount, fuel within the delivery chamber is able to flow out through the first set of outlet openings into the engine cylinder or other combustion space, and when the valve needle is moved outwardly from the bore by a greater amount, fuel within the delivery chamber is able to flow out through both sets of outlet openings. Thus, the fuel injection rate or other fuel injection characteristics can be varied, depending on the extent of outward movement of the valve needle.

One problem with conventional fuel injectors of this type is that, upon initial movement of the valve needle away from the seating, fuel within the spring chamber is able to leak into the engine cylinder through a clearance defined between the sleeve member and the nozzle body. Such fuel leakage is undesirable and can lead to a poor fuel spray pattern and poor emissions.

Another problem with such injectors is that, in use, the nozzle body is exposed to very high temperatures which can lead to the breakdown of fuel, thereby causing fuel lacquer to be deposited on the outlet openings provided in the sleeve member. This can result in significant degradation of injector performance and is a particular problem in fuel injectors for which the size of the outlet openings is relatively small.

It is an object of the present invention to provide a fuel injector in which one or more of the aforementioned problems is alleviated or overcome.

According to a first aspect of the present invention there is provided a fuel injector for delivering fuel to a combustion space, the injector comprising a valve needle movable within a bore provided in a nozzle body and engageable with a seating to control the supply of fuel from the bore, the injector further comprising means for permitting fuel to escape from the bore to a low pressure drain upon initial movement of the valve needle away from its seating to reduce fuel leakage into the combustion space.

The invention provides the advantage that fuel leakage into the combustion space is reduced, thereby improving the fuel injection spray pattern and reducing poor emissions.

The fuel injector may be of the outwardly opening type whereby movement of the valve needle outwardly from the bore moves the valve needle away from its seating to permit fuel delivery into the combustion space.

The valve needle may be moveable with a sleeve member, the sleeve member and the bore together defining a clearance through which fuel can flow upon initial movement of the valve needle away from the seating.

The sleeve member may be provided with first and second sets of outlet openings occupying different axial positions on the sleeve member such that, in use, movement of the valve needle away from the seating into a first fuel injecting position causes the first set of outlet openings to be exposed to permit fuel delivery therefrom, and movement of the valve needle away from the seating into a second fuel injecting position causes the first and second sets of outlet openings to be exposed to permit fuel delivery from both sets of outlet openings.

The means for permitting fuel to escape from the bore may conveniently take the form of a return flow passage for fuel in communication with the low pressure drain. The return flow passage may be defined, in part, by a drilling provided in the nozzle body.

The sleeve member may be provided with an annular groove or recess which communicates with the clearance, movement of the valve needle away from its seating causing the annular recess to communicate with the drilling provided in the nozzle body to permit fuel within the clearance to flow to the low pressure drain.

The fuel injector may include a cover member for covering at least a part of the nozzle body, the cover member and the nozzle body together defining at least a part of the return flow passage for fuel.

In an alternative embodiment of the invention, the bore provided in the nozzle body may be provided with an annular groove or recess. The valve needle may be provided with a return flow passage for fuel which communicates with the annular groove when the valve needle is moved away from its seating to permit fuel to escape from the bore to the low pressure drain. The return flow passage may be defined, at least in part, by a drilling provided in the valve needle.

Conveniently, the valve needle may be provided with first and second sets of outlet openings such that movement of the valve needle away from its seating permits fuel delivery through one or both sets of outlet openings depending on the extent of movement of the valve needle away from its seating.

In a further alternative embodiment of the invention, the fuel injector may be of the inwardly opening type. The injector conveniently includes a delivery chamber for fuel, fuel within the delivery chamber being able to flow through one or more outlet opening provided in the nozzle body when the valve needle is moved away from its seating.

Preferably, the return flow passage for fuel is defined, in part, by a drilling provided in the nozzle body.

The injector may include a cover member, the cover member and the nozzle body defining a part of the return flow passage. The cover member is conveniently shaped to provide a restriction to the flow of fuel through the return flow passage. Conveniently, the cover member may be shaped to form a clearance fit with the nozzle body so as to provide the restriction to the flow of fuel.

In an alternative embodiment, the cover member may be provided with an insert member which defines, at least in part, the restriction to the flow of fuel.

In any of the embodiments of the invention, the cover member may include a lip region which is arranged to sealingly engage a cap nut of the fuel injector.

The lip region may define, together with a region of the nozzle body, a part of the return flow passage for fuel.

Each set of outlet openings may include one or more outlet openings.

According to a second aspect of the present invention there is provided a fuel injector for delivering fuel to a combustion space, the injector comprising a valve needle movable within a bore provided in a nozzle body and engageable with a seating to control the supply of fuel from the bore, the injector further comprising a cover member covering at least a part of the nozzle body, the cover member defining, together with the nozzle body, a passage for fuel, whereby, in use, fuel is supplied to the passage to reduce the temperature of the nozzle body.

The invention will further be described, by way of example, with reference to the accompanying drawings, in which.

Figure 1:
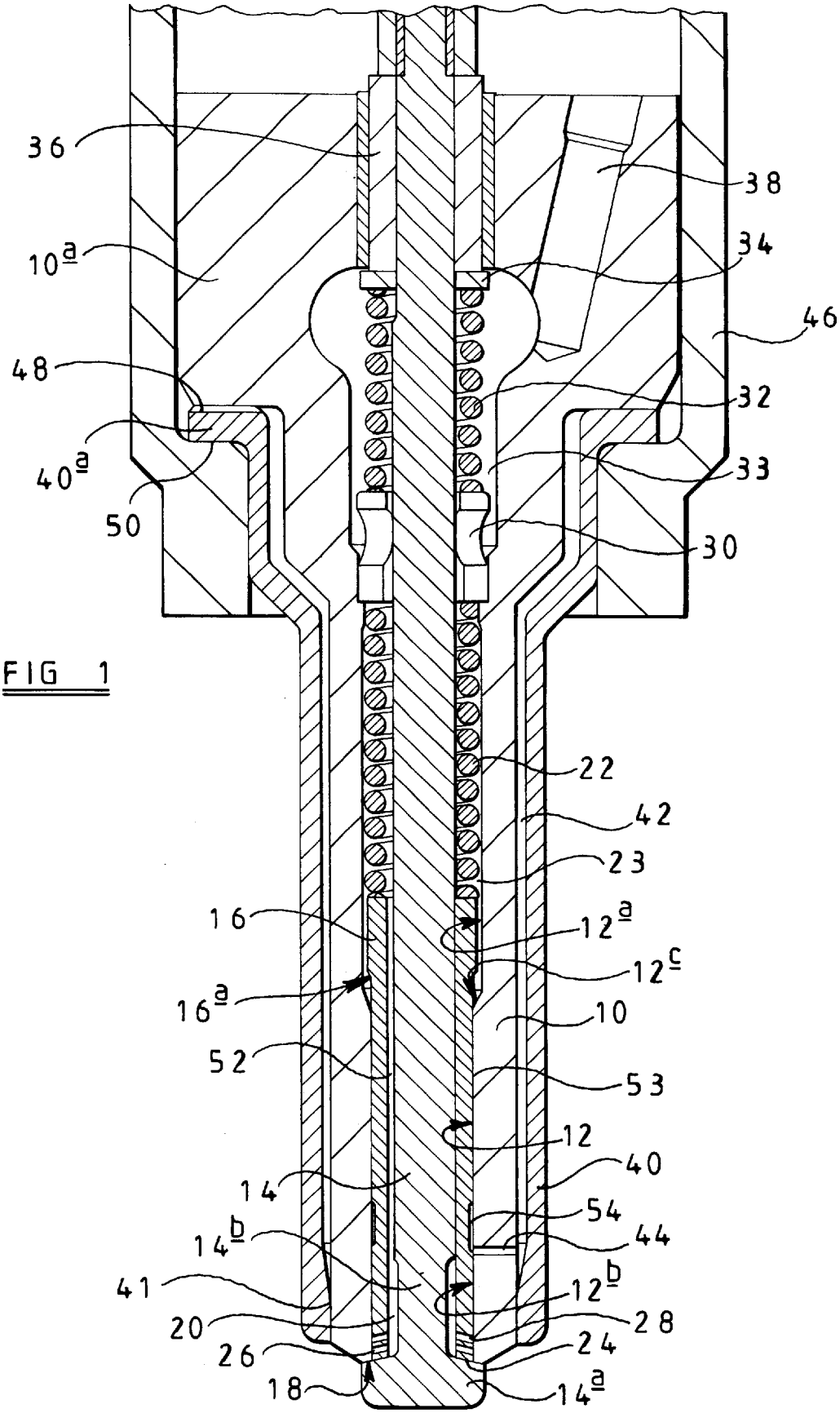
FIG. 1 is a sectional view illustrating a fuel injector of the outwardly opening type in accordance with an embodiment of the present invention.

Referring to FIG. 1, there is shown a fuel injector having a nozzle body 10 which is provided with a through bore 12 within which a valve needle 14 is slidable. The bore 12 includes an enlarged diameter region 12*a* and a region 12*b* of smaller diameter, the interconnection between the regions 12*a*, 12*b* defining a step 12*c* in the bore 12. A sleeve member 16 is received within the bore 12, the outer surface of the sleeve member 16 being of stepped form and having a step 16*a* which is engageable with the step 12*c* defined by the bore 12. The valve needle 14 extends through the sleeve member 16 and includes an end region 14*a* of enlarged diameter which projects through the lowermost open end of the bore 12 and the sleeve member 16, the end region 14*a* of the valve needle 14 being engageable with a seating 18 defined by the nozzle body 10. The valve needle 14 also includes a region of reduced diameter 14*b* which defines, together with the inner surface of the sleeve member 16, a delivery chamber 20 for fuel.

The sleeve member 16 is biased by means of a compression spring 22 and fuel pressure towards a position in which the lower surface of the sleeve member 16 engages the enlarged end region 14*a* of the valve needle 14 forming a seal at a seating 24. The compression spring 22 is housed within a spring chamber 23 defined by the region 12*a* of the bore 12. The sleeve member 16 is provided with first and second sets of outlet openings 26, 28 respectively, one end of each outlet opening 26, 28 communicating with the delivery chamber 20 such that movement of the valve needle 14 away from the seating 18 permits fuel to flow from the delivery chamber 20 out through the first set of outlet openings 26, or through both sets of outlet openings 26, 28, depending on the extent of movement of the valve needle 14 away from the seating 18.

The end of the spring 22 remote from the sleeve member 16 abuts an abutment assembly 30, the abutment assembly 30 engaging, at its end remote from the spring 22, a second compression spring 32 which is housed within a chamber 33 defined by a region of the bore 12. The end of the compression spring 32 remote from the abutment assembly 30 is in abutment with an abutment member 34 which abuts or is connected to a guide member 36 secured to the valve needle 14, the guide member 36 serving to guide sliding movement of the valve needle 14 within the bore 12. The action of the spring 32 serves to urge the valve needle 14 in an upwards direction, the spring load being applied to the valve needle 14, in part, through the abutment member 34.

In use, fuel is supplied to the chamber 33 through a supply passage 38 provided in an enlarged upper region 10*a* of the nozzle body 10, the supply passage 38 communicating with a source of fuel at high pressure such as, for example, a common rail of a common rail fuel system, to permit fuel to be delivered to the chamber 33. Movement of the valve needle 14 away from the seating 18 is controlled in a conventional way, for example by means of a piezoelectric actuator arrangement (not shown). A surface associated with the valve needle 14 is exposed to fuel pressure within a control chamber, fuel pressure within the control chamber being controlled by varying the energisation level, and hence the axial length, of a piezoelectric stack. Alternatively, movement of the valve needle 14 may be controlled in a conventional way by means of an electromagnetic actuator arrangement.

In use, fuel within the chamber 33 is able to flow to the region 12*a* of the bore via flats, slots or grooves machined on the surface of the valve needle 14. The fuel delivered to the region 12*a* of the bore is able to flow to the delivery chamber 20 by means of a narrow clearance passage 52 defined between the inner surface of the sleeve member 16 and flats, slots or grooves provided on the surface of the valve needle 14. The effective areas of the valve needle 14 exposed to fuel pressure within the bore 12 are chosen to ensure that, with fuel under high pressure delivered to the bore 12, the valve needle 14 is urged against the seating 18 by the fuel pressure and the spring 32 to prevent fuel delivery into the engine cylinder or other combustion space.

The nozzle body 10 is provided with a cover member 40 which covers a part of the length of the nozzle body 10, the outer surface of the nozzle body 10 and the inner surface of the cover member 40 together defining a flow passage 42 for fuel. At its lowermost end in the illustration shown in FIG. 1, the cover member 40 is shaped to form an interference fit with the nozzle body 10 so as to form a substantially fluid tight seal 41. The nozzle body 10 is also provided with a drilling 44 defining a flow path for fuel, one end of the drilling 44 being in communication with the flow passage 42. The sleeve member 16 is provided with an annular groove or recess 54 such that, in use when the valve needle 14 is moved away from the seating 18, the annular groove 54 communicates with the drilling 44 provided in the nozzle body 10.

The cover member 40 and the nozzle body 10 are received within a cap nut 46. During assembly of the injector, a load is applied to a lip region 40*a* of the cover member 40 to clamp the lip region 40*a* between the cap nut 46 and the upper region 10*a* of the nozzle body 10 such that the lower surface of the lip region 40*a* and the cap nut 46 form a substantially fluid tight seal 50. The lip region 40*a* of the cover member 40 is shaped such that it defines, together with a surface of the region 10*a* of the nozzle body 10, a narrow clearance 48 for fuel which communicates, at one end, with the passage 42. The other end of the clearance 48 communicates with a low pressure drain or fuel reservoir (not shown), the drilling 44, the passage 42 and the clearance 48 thereby providing a return flow passage for fuel to permit fuel to flow from the annular groove 54 to the low pressure drain. It will be appreciated that, as the clearance 48 is only of relatively small dimension, fuel is only able to flow through the return flow passage to the low pressure drain at a restricted rate.

Operation of the fuel injector in FIG. 1 is as follows. In use, fuel under high pressure is supplied to the chamber 33 through the supply passage 38, fuel flowing into the chamber 23 and then the delivery chamber 20 via the clearance passage 52. The lower surface of the sleeve member 16 is biased into sealing engagement with the enlarged end region 14*a* of the valve needle by means of the spring 22 and by fuel pressure to maintain a substantially fluid tight seal at the seating 24. As the first and second sets of outlet openings 26, 28 remain covered by the nozzle body 10, fuel is unable to flow out through the outlet opening into the engine cylinder during this stage of operation.

When fuel injection is to be commenced, the piezoelectric actuator is energised such that fuel pressure within the control chamber acting on a surface associated with the valve needle 14 provides a downward force on the valve needle 14 which is sufficient to overcome the force due to fuel pressure within the bore 12. Thus, the valve needle 14 is moved outwardly from the bore 12 (downwardly in FIG. 1), the enlarged end region 14*a* of the valve needle 14 moving away from the seating 18 to expose the first set of outlet openings 26, the force due to the spring 22 and fuel pressure maintaining the seal between the sleeve member 16 and the enlarged region 14*a* of the valve needle 14 at seating 24. During this stage of operation, fuel within the delivery chamber 20 is able to flow through the first set of outlet openings 26 into the engine cylinder.

Additionally, upon initial movement of the valve needle 14 outwardly from the bore 12, any fuel leakage through a clearance 53 defined between the nozzle body 10 and the sleeve member 16 will flow into the annular groove 54, into the drilling 44 and, hence, into the passage 42. As the passage 42 communicates, via the clearance 48, with the low pressure drain, any fuel flowing into the groove 54 will therefore escape to low pressure, rather than leaking into the engine cylinder. In conventional fuel injectors of the outwardly opening type, fuel within the chamber 23 may flow through the clearance defined between the sleeve member 16 and the nozzle body 10, causing fuel to leak into the engine cylinder upon initial outward movement of the valve needle within its bore. Such undesirable fuel leakage can lead to poor emissions. This problem is alleviated in the present invention and fuel leakage into the engine cylinder is reduced or substantially removed.

In order to terminate injection, the actuator arrangement is de-energised from the first energisation level, thereby causing fuel pressure within the control chamber acting on the surface associated with the valve needle 14 to be reduced. The valve needle 14 therefore moves inwardly due to fuel pressure within the bore 12 until the enlarged region 14*a* engages the seating 18 defined by the nozzle body 10. Fuel is therefore unable to flow out through the first set of outlet openings 26 and fuel injection ceases.

Alternatively, in order to increase the fuel injection rate, the actuator may be energised to a second, higher energisation level causing fuel pressure within the control chamber acting on the surface associated with the valve needle 14 to be further increased, the valve needle 14 therefore moving outwardly away from the seating 18 into a second fuel injecting position in which both the first and second outlet openings 26,28 are exposed. Thus, fuel within the delivery chamber 20 is able to flow out through the first and second outlet openings 26, 28 at an increased rate. The extent of outward movement of the valve needle 14 is limited by engagement between the step 16*a* provided on the sleeve member 16 and the step 12*c* defined by the bore 12, the step 16*a* engaging the step 12*c* so as to form a substantially fluid tight seal to prevent fuel flow therepast. Thus, during this stage of operation, fuel leakage between the nozzle body 10 and the sleeve member 16 is substantially eliminated.

In order to cease fuel injection, the piezoelectric actuator is de-energised causing fuel pressure within the control chamber acting on the surface associated with the valve needle 14 to be reduced and thereby causing the valve needle 14 to move inwardly until the enlarged end region 14*a* engages the seating 18. The first and second sets out outlet openings 26, 28 are therefore closed by the nozzle body 10 and fuel injection is ceased. Alternatively, if it is desired to inject fuel at a decreased rate, the piezoelectric actuator may be de-energised to the first energisation level, thereby causing the valve needle 14 to move inwardly to such that only the first set of outlet openings 26 are exposed, In addition to reducing fuel leakage into the engine cylinder upon initial outward movement of the valve needle 14, the present invention also provides the advantage that fuel flowing through the passage 42 to the low pressure drain is able to absorb heat from the nozzle body 10, thereby serving to reduce the temperature of the nozzle body. In order to further enhance temperature reduction of the nozzle body 10, at least a part of the nozzle body 10 and the valve needle 14 may be coated with a material having a lower thermal conductivity than the material of the nozzle body and the valve needle. For example, the nozzle body may be formed from steel and a coating formed from a ceramic material. It will be appreciated, however, that other types of coating may be applied to the exterior of the nozzle body to improve the insulation of the nozzle body 10 and the valve needle 14. Preferably, the coating is applied to the surface of the nozzle body 10 protruding through the cover member 40 and to the exposed surface of the enlarged end region 14*a* of the valve needle 14, as indicated by the region marked X in FIG. 2.

Figure 2:
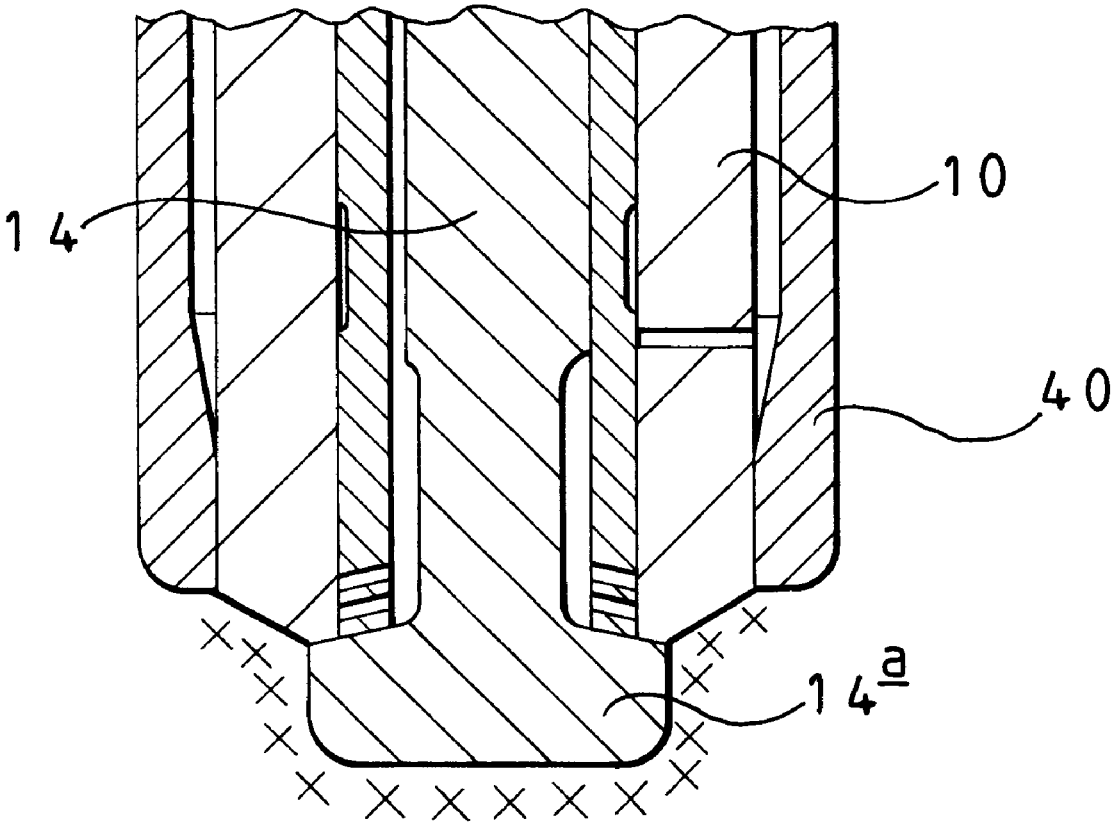
FIG. 2 is an enlarged sectional view of a part of the fuel injector in FIG. 1.
Figure 3:
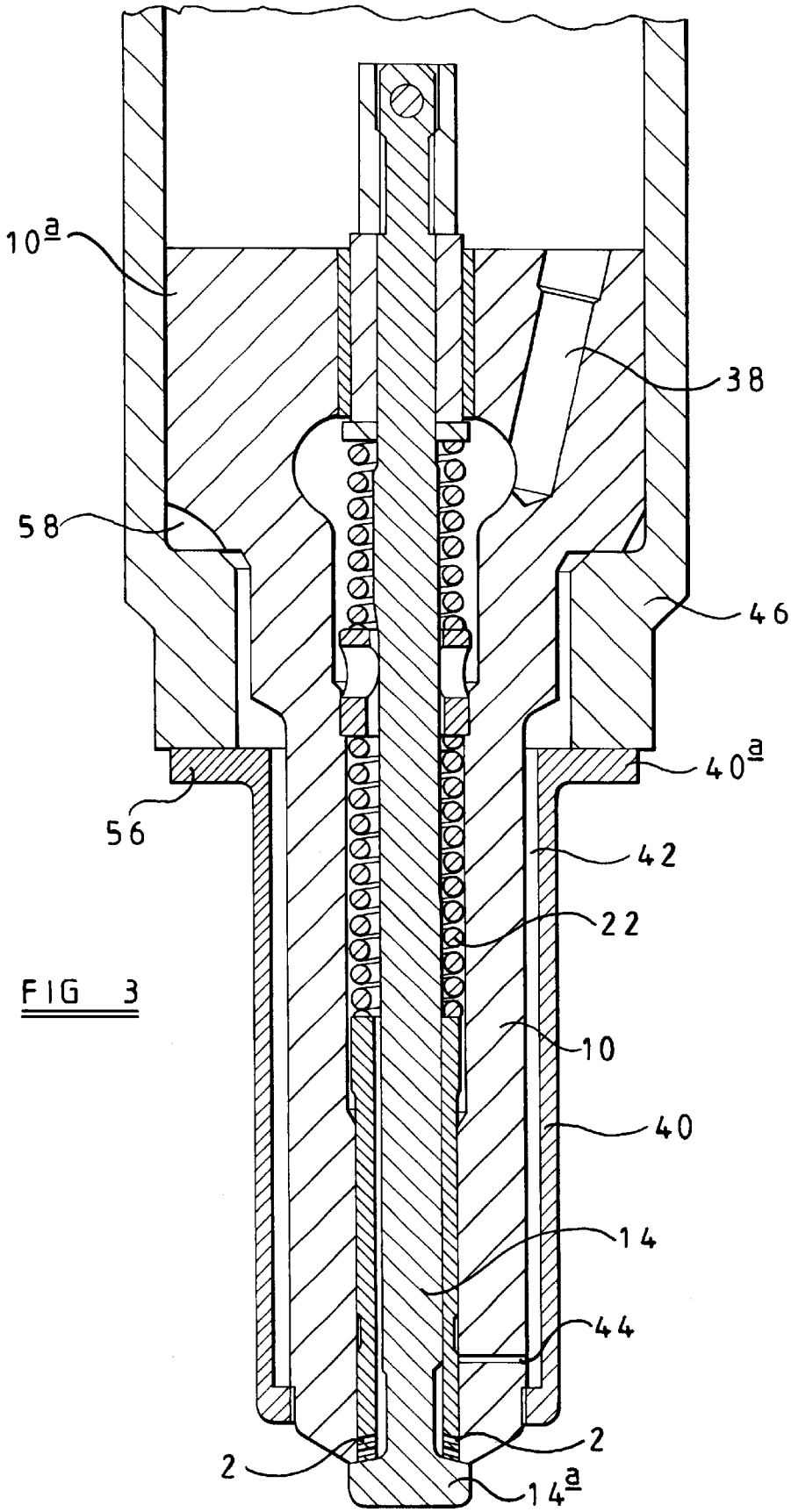
FIGS. 3 and 4 are sectional views of alternative embodiments to those shown in FIGS. 1 and 2.

FIG. 3 shows an alternative embodiment of the invention in which similar parts to those shown in FIGS. 1 and 2 are denoted with the same reference numerals. In this embodiment, only the nozzle body 10 is received within the cap nut 46, the lip region 40*a* of the cover member 40 being in abutment with a lower surface of the cap nut 46 so as to form a substantially fluid tight seal 56. In a conventional arrangement, a washer member is usually inserted between the cap nut 46 and the cylinder head (not shown). In the embodiment in FIG. 3, the region 40*a* of the cover member 40 may take the place of this washer member. Additionally, the region 10*a* of the nozzle body 10 is provided with a flat, recess or groove 58 which communicates with the passage 42 to permit fuel in the passage 42 to flow to the low pressure drain.

Figure 4:
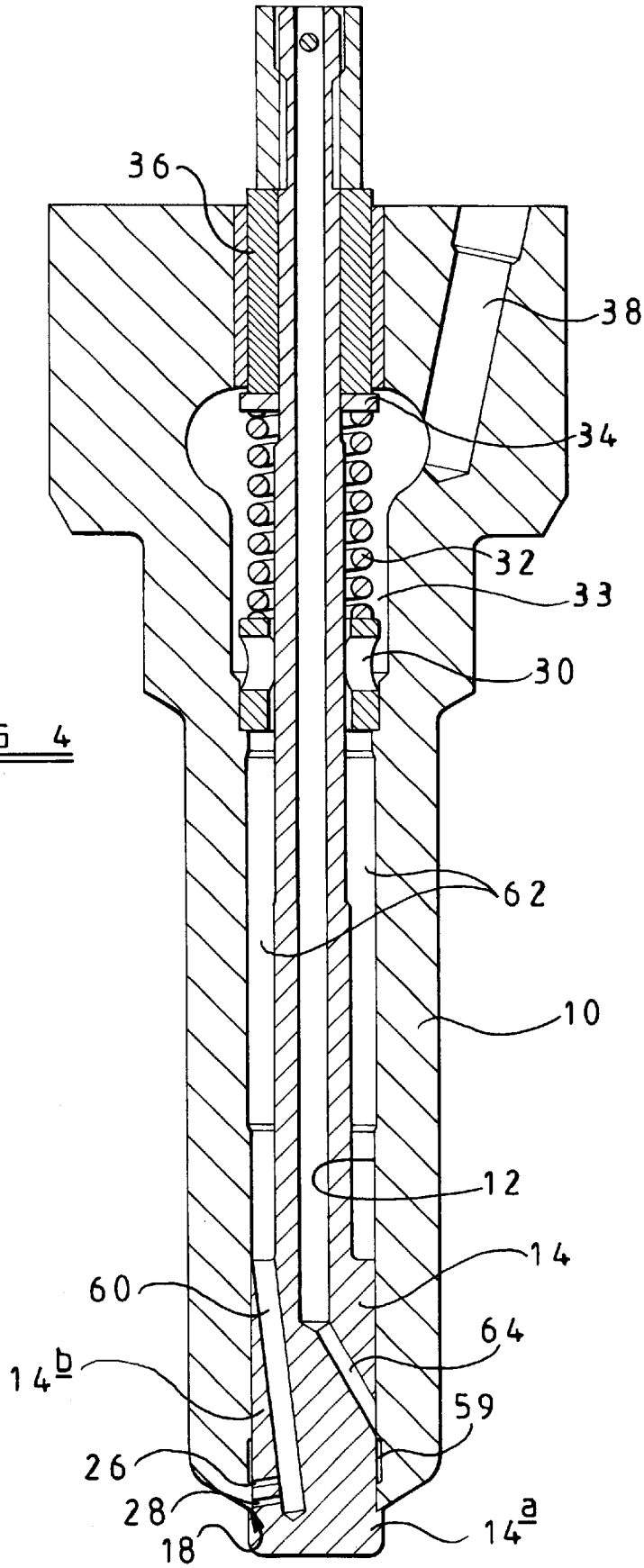

FIG. 4 shows a further alternative embodiment of the invention in which like reference numerals are used to denote similar parts to those shown in FIGS. 1 to 3. In this embodiment of the invention, the sleeve member is removed, the outlet openings 26, 28 being defined in a region 14*b* of the valve needle 14 adjacent the end region 14*a*. The region 14*b* of the valve needle 14 is provided with a drilling 60 which defines, in part, a flow passage for fuel between the chamber 33 and the outlet openings 26,28. Fuel is able to flow from the chamber 33 to the drilling 60 by means of flats, slots or grooves 62 provided on the surface of the valve needle 14.

The valve needle 14 is also provided with a further drilling 64 which defines, in part, a flow passage for fuel to permit fuel flow to the low pressure drain.

The nozzle body 10 is provided with an annular groove or recess 59 such that, in use, upon initial movement of the valve needle 14 away from the seating 18, the annular groove 59 is brought into communication with the drilling 64 provided in the valve needle 14 to permit any fuel leakage between the nozzle body 10 and the valve needle 14 to flow into the groove 59 and through the drilling 64 to low pressure, rather than leaking into the engine cylinder or other combustion space. It will be appreciated that the drilling 64 provided in the valve needle may be arranged to communicate with any passage or chamber forming part of the fuel injector which communicates with the low pressure drain.

It will be appreciated that the embodiment of the invention in FIG. 4 need not be provided with the cover member 40 as the return flow path for fuel is defined within the valve needle 14 itself. However, a cover member may be provided, fuel being supplied to the cover member through leakage from a source of fuel within the injector to reduce the temperature of the nozzle body 10, as described previously.

Figure 5:
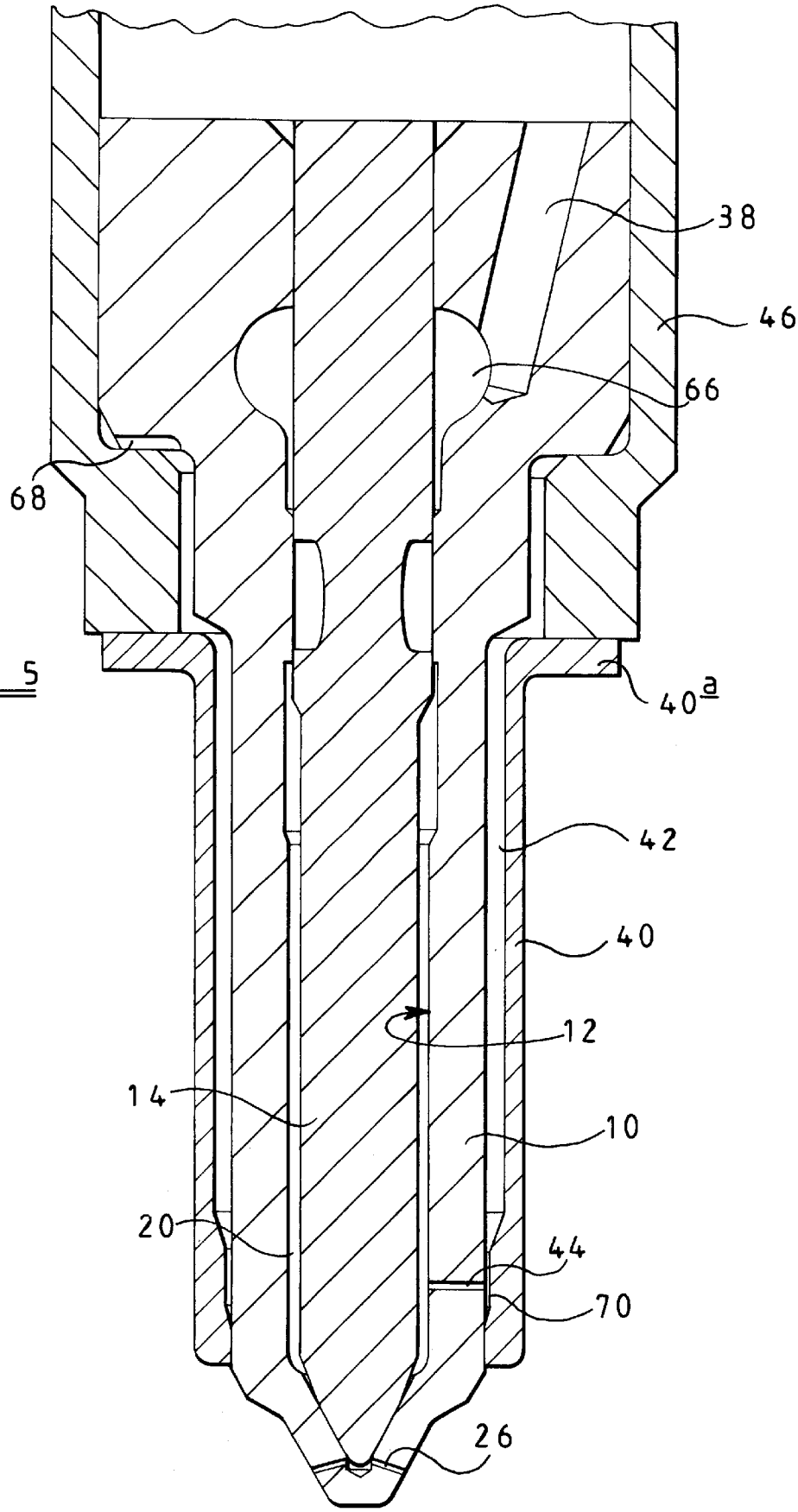
FIG. 5 is a sectional view of a fuel injector of the inwardly opening type in accordance with a further alternative embodiment of the invention.

The present invention may also take the form of an inwardly opening fuel injector, as shown in FIG. 5. The fuel injector includes a valve needle 14 which is engageable with the seating defined by the nozzle body 10 to control fuel delivery through outlet openings 26 provided in the nozzle body 10. The valve needle 14 and the bore 12 together define a delivery chamber 20 for fuel. In use, fuel is supplied through the supply passage 38 to an annular chamber 66, the fuel flowing from the chamber 66 to the delivery chamber 20 by means of flats, slots or grooves provided on the valve needle 14. Movement of the valve needle 14 away from the seating to permit fuel delivery may be controlled in a conventional manner using an appropriate actuator arrangement, as described previously. The cover member 40 includes a region 40*a* in sealing engagement with the cap nut 46, as described previously with reference to FIG. 3, the cover member 40 and the nozzle body 10 together defining a flow passage 42 for fuel which communicates with a recess or groove 68 provided on the nozzle body 10 to permit fuel within the passage 42 to flow to low pressure. The cover member 40 is shaped to define a restriction 70 to the flow of fuel from the drilling 44 to the passage 42 and the low pressure drain so that the rate at which fuel is able to escape through the drilling is limited. The provision of the drilling 44 and the flow passage 42 serves to reduce the temperature of the nozzle body 10 as fuel flowing through the passage 42 will absorb heat.

As an alternative to the embodiment shown in FIG. 5, the cover member 40 may be provided with an insert member which defines, together with a part of the exterior surface of the nozzle body 10, the restriction 70 to fuel flowing from the drilling 44 into the passage 42. It will be appreciated that the cover member 40 in FIG. 5 may also take the form of the cover member shown in FIG. 1.

The inwardly opening fuel injector shown in FIG. 5 may also take the form of a two-stage lift injector, having two sets of outlet openings.

In a further alternative embodiment to that shown in FIG. 5, the drilling 44 may be omitted, the passage 42 filling with fuel through leakage from other sources within the injector. This provides the advantage that no fuel is able to escape from the delivery chamber 20, in use. Additionally, the temperature of the nozzle body 10 will be reduced as heat is transferred from the nozzle body 10 to fuel within the passage 42.

Where the fuel injector of the present invention is provided with the cover member 40, the cover member 40 may preferably be arranged to cooperate with the pocket of the cylinder head within which the nozzle body is received in an interference fit, or near interference fit, to further improve heat transfer away from the nozzle body 10.

It will be appreciated that the seal formed between the cover member 40 and the nozzle body 10 in any of the embodiments of the invention may be formed by a conical seal, a face seal, by welding or other fastening means. Additionally, it will be appreciated that, in any of the embodiments of the invention described herein, a portion of the nozzle body and/or the valve needle 14 may be provided with a suitable coating to reduce the temperature of the nozzle body 10, thereby reducing build up of fuel lacquer deposits in the region of the outlet openings. It will further be appreciated that the number of outlet openings provided in the nozzle body, in the sleeve member or in the valve needle may be different to that shown in the accompanying drawings.

What is claimed:

1. A fuel injector for delivering fuel to a combustion spaces, the fuel injector being of an outwardly opening type, comprising a valve needle, a nozzle body provided with a bore, a seating and a low pressure drain, the valve needle being moveable within the bore provided in the nozzle body and engageable with the seating to control the supply of fuel from the bore, and further comprising means for opening communication between the bore and the low pressure drain upon initial movement of the valve needle away from its seating, where movement of the valve needle outwardly from the bore moves the valve needle away from its seating to permit fuel delivery into the combustion space.

2. A fuel injector as claimed in claim 1, additionally comprising a return flow passage, said return flow passage providing communication between the bore and the low pressure drain upon initial movement of the valve needle away from its seating.

3. A fuel injector as claimed in claim 2 additionally comprising a drilling in the nozzle body, said drilling defining at least in part said return flow passage.

4. A fuel injector as claimed in claim 2 additionally comprising a cover member for covering at least a part of the nozzle body, the cover member and the nozzle body together defining at least a part of the return flow passage.

5. A fuel injector as claimed in claim 4 wherein the cover member is shaped to provide a restriction to the flow of fuel through the return flow passage.

6. A fuel injector for delivering fuel to a combustion space comprising a valve needle, a nozzle body provided with a bore, a seating, a low pressure drain and a sleeve member, the valve needle being moveable within the bore provided in the nozzle body and engageable with the seating to control the supply of fuel from the bore, and the bore being in communication with the low pressure drain upon initial movement of the valve needle away from its seating, the valve member being movable with the sleeve member, the sleeve member and the bore together defining a clearance through which fuel can flow upon initial movement of the valve needle away from the seating.

7. A fuel injector as claimed in claim 6, wherein the sleeve member is provided with first and second sets of outlet openings occupying different axial positions on the sleeve member such that, in use, movement of the valve needle away from the seating into a first fuel injecting position causes the first set of outlet openings to be exposed to permit fuel delivery therefrom, and movement of the valve needle away from the seating into a second fuel injecting position causes the first and second sets of outlet openings to be exposed to permit fuel delivery from both sets of outlet openings.

8. A fuel injector as claimed in claim 6, wherein the sleeve member is provided with an annular groove or recess which communicates with the clearance, movement of the valve needle away from its seating causing the annular groove or recess to communicate with the low pressure drain whereby to permit fuel within the clearance to flow to the low pressure drain.

* * * * *